US009796560B2

(12) United States Patent
Fargo

(10) Patent No.: US 9,796,560 B2
(45) Date of Patent: Oct. 24, 2017

(54) DETECTION OF STUCK ELEVATOR CAR OR COUNTERWEIGHT

(71) Applicant: Otis Elevator Company, Farmington, CT (US)

(72) Inventor: Richard N. Fargo, Plainville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/035,542

(22) PCT Filed: Nov. 12, 2013

(86) PCT No.: PCT/US2013/069663
§ 371 (c)(1),
(2) Date: May 10, 2016

(87) PCT Pub. No.: WO2015/072973
PCT Pub. Date: May 21, 2015

(65) Prior Publication Data
US 2016/0272462 A1 Sep. 22, 2016

(51) Int. Cl.

| | |
|---|---|
| ***B66B 11/08*** | (2006.01) |
| ***B66B 5/02*** | (2006.01) |
| ***B66B 1/44*** | (2006.01) |
| ***B66B 5/00*** | (2006.01) |
| ***B66B 1/34*** | (2006.01) |

(52) U.S. Cl.
CPC ..... *B66B 5/0031* (2013.01); *B66B 1/3476* (2013.01); *B66B 5/02* (2013.01); *B66B 11/08* (2013.01)

(58) Field of Classification Search
CPC ..... B66B 5/0018; B66B 5/0031; B66B 11/08; B66B 11/008; B66B 11/06; B66B 11/043; B66B 5/02
See application file for complete search history.

(56) References Cited

U.S. PATENT DOCUMENTS

| | | | |
|---|---|---|---|
| 6,325,179 | B1 | 12/2001 | Barreiro et al. |
| 2008/0185232 | A1 | 8/2008 | Henneau |
| 2010/0133046 | A1 | 6/2010 | Allwardt et al. |

FOREIGN PATENT DOCUMENTS

| | | | |
|---|---|---|---|
| EP | 2292546 | A1 | 3/2011 |
| JP | H06024668 | A | 2/1994 |
| JP | H06084233 | B2 | 10/1994 |
| JP | 2013227115 | A | 11/2013 |
| WO | 2007144456 | A1 | 12/2007 |
| WO | 2013045581 | A1 | 4/2013 |

OTHER PUBLICATIONS

AIPN Machine Translation, JP 2013-227115 A, Sep. 28, 2016, pp. 1-18.*
International Search Report and Written Opinion for application PCT/US2013/069663, dated Aug. 18, 2014, 14 pages.

* cited by examiner

*Primary Examiner* — William A Rivera
*Assistant Examiner* — Stefan Kruer
(74) *Attorney, Agent, or Firm* — Cantor Colburn LLP

(57) ABSTRACT

A method of detecting a stuck car or a stuck counterweight in an elevator system having a machine for imparting motion to the car and counterweight includes sensing a car side suspension member tension, T1; sensing a counterweight side suspension member tension, T2; determining a traction ratio in response to a relationship between T1 and T2; and determining a stuck car or a stuck counterweight if the traction ratio violates a limit.

7 Claims, 3 Drawing Sheets

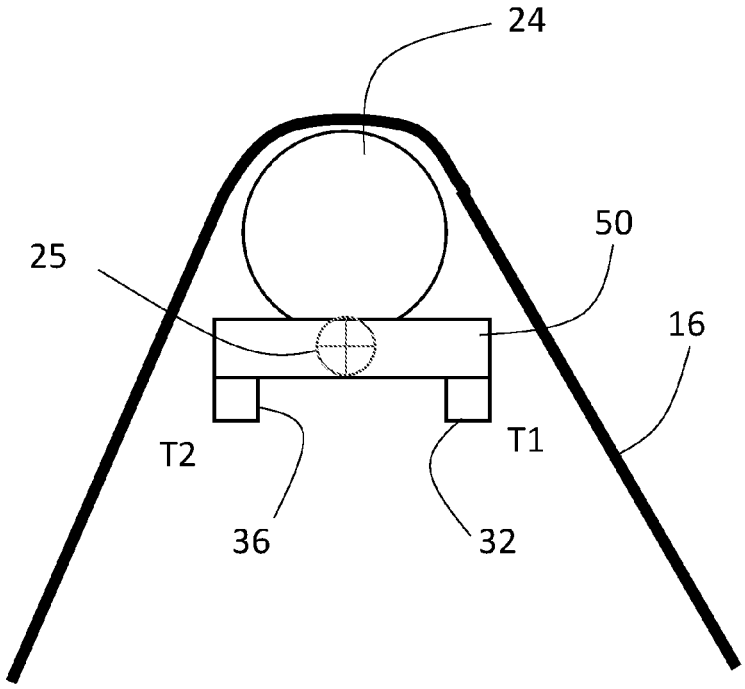
FIG. 3
Amended

DETECTION OF STUCK ELEVATOR CAR OR COUNTERWEIGHT

BACKGROUND

The subject matter disclosed herein relates to elevator systems. More specifically, the subject disclosure relates to detection of a stuck elevator car or a stuck counterweight.

In order to assure safety, codes require that the car or counterweight must not be lifted, if the counterweight or car becomes stuck in the hoistway, for example on the rails or buffer. Codes prescribe a loss of traction test which must be passed to demonstrate that the car or counterweight will not be lifted if the counterweight or car is stuck. This loss of traction test puts an upper limit on the value of friction or traction between the machine sheave and a suspension member. To meet the loss of traction requirement, one solution includes using friction modifier(s) in the suspension member, which may adversely affect other performance parameters of the suspension member. Another solution includes adding weight to the car to assure that the test can be passed. Both of these solutions add cost and limit performance.

BRIEF DESCRIPTION

In one embodiment, a method of detecting a stuck car or a stuck counterweight in an elevator system having a machine for imparting motion to the car and counterweight includes sensing a car side suspension member tension, T1; sensing a counterweight side suspension member tension, T2; determining a traction ratio in response to a relationship between T1 and T2; and determining a stuck car or a stuck counterweight if the traction ratio violates a limit.

Additionally or alternatively, in this or other embodiments, determining if the traction ratio violates the limit includes determining that the counterweight is stuck when T1/T2 exceeds an upper limit or T2/T1 goes below a lower limit.

Additionally or alternatively, in this or other embodiments, determining if the traction ratio violates the limit includes determining that the car is stuck when T1/T2 goes below a lower limit or T2/T1 exceeds an upper limit.

Additionally or alternatively, this or other embodiments include stopping the machine in response to the traction ratio violating the limit.

Additionally or alternatively, this or other embodiments include stopping the machine in response to the traction ratio violating the limit for more than a predetermined time.

In another embodiment, an elevator system includes a car; a counterweight; a suspension member suspending the car and the counterweight; a machine having a traction sheave, the suspension member positioned about the traction sheave; a car side suspension member load sensor sensing a car side suspension member tension, T1; a counterweight suspension member load sensor sensing a counterweight side suspension member tension, T2; and a controller determining a traction ratio in response to a relationship between T1 and T2, the controller determining a stuck car or a stuck counterweight if the traction ratio violates a limit.

Additionally or alternatively, this or other embodiments include the controller determining that the counterweight is stuck when T1/T2 exceeds an upper limit or when T2/T1 goes below a lower limit.

Additionally or alternatively, this or other embodiments include the controller determining that the car is stuck when T1/T2 goes below a lower limit or T2/T1 exceeds an upper limit.

Additionally or alternatively, this or other embodiments include the controller stopping the machine in response to the traction ratio violating the limit.

Additionally or alternatively, this or other embodiments include the controller stopping the machine in response to the traction ratio violating the limit for more than a predetermined time.

Additionally or alternatively, this or other embodiments include the car side suspension member load sensor positioned at a car side termination of the suspension member and the counterweight side suspension member load sensor positioned at a counterweight side termination of the suspension member.

Additionally or alternatively, this or other embodiments include a bed plate for supporting the machine, the bed plate rotatable about an axis; the car side suspension member load sensor being coupled to the bed plate and the counterweight side suspension member load sensor being coupled to the bed plate.

Additionally or alternatively, this or other embodiments include the controller adjusting the car side suspension member tension, T1, and the counterweight side suspension member tension, T2, prior to determining the traction ratio.

Additionally or alternatively, this or other embodiments include the controller adjusting the car side suspension member tension, T1, and the counterweight side suspension member tension, T2, by subtracting a portion of machine weight from at least one of the car side suspension member tension, T1, and the counterweight side suspension member tension, T2, prior to determining the traction ratio.

BRIEF DESCRIPTION OF THE DRAWINGS

FIG. 3 depicts a machine in an exemplary embodiment.

The detailed description explains the invention, together with advantages and features, by way of examples with reference to the drawings.

DETAILED DESCRIPTION

Figure 1:
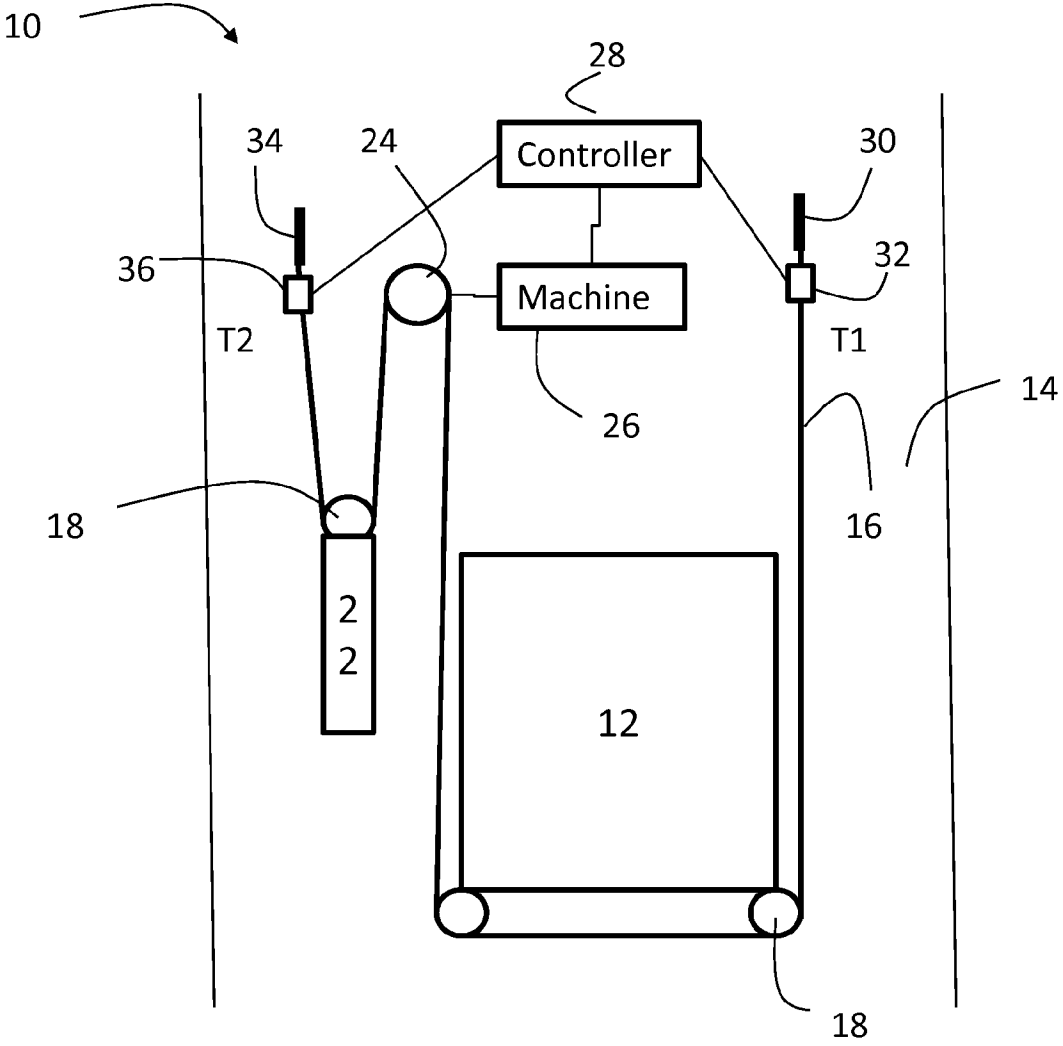
FIG. 1 depicts an elevator system in an exemplary embodiment.

Shown in FIG. 1 is an exemplary traction elevator systems 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more suspension members 16. Suspension member 16 may comprise a belt (e.g., a coated steel belt), rope or other member. Further, multiple suspension members 16 may be arranged in parallel.

Suspension member 16 interacts with one or more deflector sheaves 18 to be routed around various components of the elevator system 10. Suspension member 16 is coupled to a counterweight 22, which is used to help balance the elevator system 10 and reduce the difference in suspension member tension on both sides of the traction sheave 24 during operation. Embodiments of the invention may be used on elevator systems having suspension member configurations other than the exemplary type shown in FIG. 1.

A machine 26 drives the traction sheave 24. Movement of the traction sheave 24 by the machine 26 imparts motion (through traction) to suspension member 16 routed around the traction sheave 24. Machine 26 responds to drive signals from a controller 28. Controller 28 may be implemented using a general-purpose microprocessor executing a computer program stored on a storage medium to perform the operations described herein. Alternatively, controller 28 may be implemented in hardware (e.g., ASIC, FPGA) or in a combination of hardware/software. Controller 28 may also be part of an elevator control system.

A first end of suspension member 16 is terminated at a car side termination 30. A car side suspension member load sensor 32 monitors tension on suspension member 16 at the car side termination 30. Suspension member 16 may be terminated to the car side suspension member load sensor 32, which is connected to the car side termination 30. Alternatively, suspension member 16 may be terminated to car side termination 30, and the car side suspension member load sensor 32 coupled to suspension member 16 (e.g., a strain sensor positioned on the suspension member).

A second end of suspension member 16 is terminated at a counterweight side termination 34. A counterweight side suspension member load sensor 36 monitors tension on suspension member 16 at the counterweight side termination 34. Suspension member 16 may be terminated to the counterweight side suspension member load sensor 36, which is connected to the counterweight side termination 34. Alternatively, suspension member 16 may be terminated to counterweight side termination 34, and the counterweight side suspension member load sensor 36 coupled to suspension member 16 (e.g., a strain sensor positioned on the suspension member).

Car side suspension member load sensor 32 generates a car side suspension member tension signal that is provided to controller 28. The car side suspension member tension signal may be a non-discrete voltage (e.g., analog signal), a discrete signal produced by multiple sensors or a digital signal. The resolution of the car side suspension member tension signal is sufficient to accurately determine a traction ratio without failing to detect a stuck car/counterweight or generate a false positive. Counterweight side suspension member load sensor 36 generates a counterweight side suspension member tension signal that is provided to controller 28. The counterweight side suspension member tension signal may be a non-discrete voltage (e.g., analog signal), a discrete signal produced by multiple sensors or a digital signal. The resolution of the counterweight side suspension member tension signal is sufficient to accurately determine a traction ratio without failing to detect a stuck car/counterweight or generate a false positive. Controller 28 executes a process to detect whether car 12 or counterweight 22 is stuck. If either the car 12 or counterweight 22 is stuck, then operation of the elevator system 10 is stopped and a rescue operation may be initiated.

Figure 2:
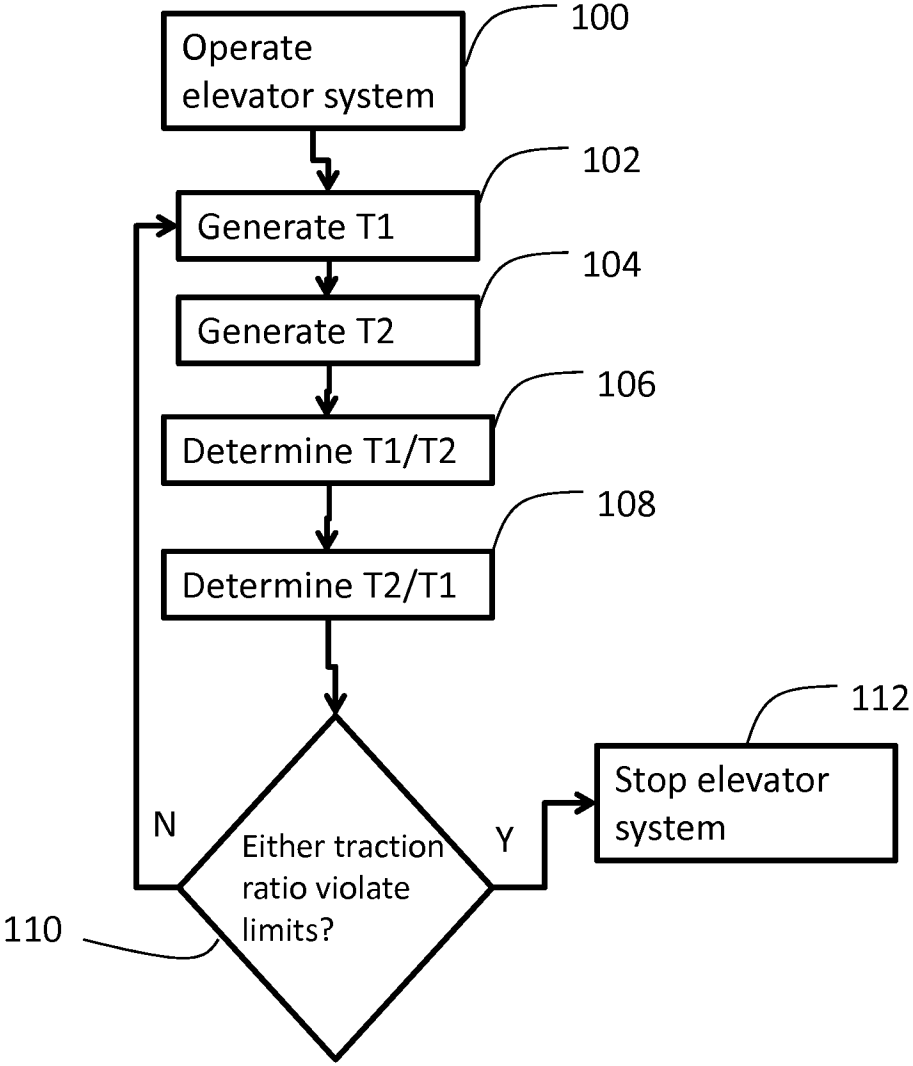
FIG. 2 depicts a process of detecting a stuck car or stuck counterweight in an exemplary embodiment.

FIG. 2 is a flowchart of a process for determining if car 12 or counterweight 22 is stuck. At 100, elevator system 10 is placed into operation. At 102, car side suspension member load sensor 32 generates the car side suspension member tension signal, T1, indicative of tension on the suspension member 16 at the car side termination 30. If multiple suspension members 16 are used, T1 represents a sum of the tension on the suspension members 16 terminated at the car side termination 30. At 104, counterweight side suspension member load sensor 36 generates the counterweight side suspension member tension signal, T2, indicative of tension on the suspension member 16 at the counterweight side termination 34. If multiple suspension members 16 are used, T2 represents a sum of the tension on the suspension members 16 terminated at the counterweight side termination 30.

At 106, controller 28 determines a first traction ratio by deriving T1/T2. At 108, controller 28 determines a second traction ratio by deriving T2/T1. At 110, controller 28 determines if either the first traction ratio or the second traction ratio violates a limit. The limit may represent an upper limit or lower limit. For example, if car 12 is traveling upwards and the counterweight 22 becomes stuck, then T2 will decrease, causing T1/T2 to increase and T2/T1 to decrease. If T1/T2 exceeds an upper limit or T2/T1 goes below a lower limit, controller 28 determines that counterweight 22 is stuck. When the counterweight 22 is traveling up and car 12 becomes stuck, T1 will decrease, causing T1/T2 to decrease and T2/T1 to increase. If T1/T2 goes below a lower limit or T2/T1 exceeds an upper limit, controller 28 determines that car 12 is stuck. The upper limits and lower limits may be established based on the weight of suspension member(s) 16, the number of floors in the building, etc.

If at 110, the first traction ratio T1/T2 or the second traction ratio T2/T1 exceeds an upper limit or goes below a lower limit, then flow proceeds to 112 where controller 28 stops the car. At 110, the violation of the limit may need to be present for a predetermined amount of time, in order to filter out spurious increases or decreases in suspension member tension that are not indicative of a stuck car or stuck counterweight. Block 112 may also include a initiating a rescue operation where machine 26 attempts to move the stuck car 12 or counterweight 22 by reversing direction. If at 110 no limits are violated, flow returns to 102 where the process continues.

FIG. 3 depicts the car side suspension member load sensor 32 and counterweight side suspension member load sensor 36 positioned under a bed plate 50 that supports machine 26 and traction sheave 24 As described above with reference to FIGS. 1 and 2, the car side suspension member load sensor 32 generates a car side suspension member tension signal, T1, that is provided to controller 28. Counterweight side suspension member load sensor 36 generates a counterweight side suspension member tension signal, T2, that is provided to controller 28. If one side of suspension member 16 traversing traction sheave 24 loses tension, then the bedplate 50 will rotate about a horizontal axis 25, parallel to the axis of rotation of the traction sheave 24, away from that side due to the tension imbalance across traction sheave 24. Controller 28 executes the process of FIG. 2 to detect whether car 12 or counterweight 22 is stuck. The tension signals T1 and T2 may be compensated to account for the weight of machine 26. For example, the car side suspension member load sensor 32 may generate a signal corresponding to the car side suspension member tension signal, T1, plus a portion of the weight of the machine 26 (e.g., ½the machine weight). Similarly, the counterweight side suspension member load sensor 36 may generate a signal corresponding to the counterweight side suspension member tension signal, T2, plus a portion of the weight of the machine 26. Controller 28 can adjust the car side suspension member tension signal, T1, and the counterweight side suspension member tension signal, T2, by subtracting the portion of the machine weight from each signal prior to computing the traction ratio.

Embodiments described above depict the car side suspension member tension signal and the counterweight side suspension member tension signal being provided to a controller 28 for processing. In exemplary embodiments, controller 28 is part of a standalone safety system, and not a component of the elevator system 10 for processing elevator calls and driving machine 26. In such embodiments, controller 28 would initiate stopping the car (e.g., breaking a safety chain to apply a brake).

Embodiments of the invention eliminate the upper limit on suspension member traction in order to pass the loss of traction test. Embodiments allow for the use of light weight cars, which reduces cost and sizing demands on machine 26.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An elevator system comprising:

a car;

a counterweight;

a suspension member suspending the car and the counterweight;

a machine having a traction sheave, the suspension member positioned about the traction sheave;

a car side suspension member load sensor sensing a car side suspension member tension, T1;

a counterweight suspension member load sensor sensing a counterweight side suspension member tension, T2;

a controller determining a traction ratio in response to a relationship between T1 and T2, the controller determining a stuck car or a stuck counterweight if the traction ratio violates a limit;

a bed plate for supporting the machine, the bed plate rotatable about an axis parallel to an axis of rotation of the traction sheave;

the car side suspension member load sensor being coupled to the bed plate and the counterweight side suspension member load sensor being coupled to the bed plate.

2. The elevator system of claim 1 wherein:

the controller adjusts the car side suspension member tension, T1, and the counterweight side suspension member tension, T2, prior to determining the traction ratio.

3. The elevator system of claim 2 wherein:

the controller adjusts the car side suspension member tension, T1, and the counterweight side suspension member tension, T2, by subtracting a portion of machine weight from at least one of the car side suspension member tension, T1, and the counterweight side suspension member tension, T2, prior to determining the traction ratio.

4. The elevator system of claim 1 wherein:

the axis parallel to the axis of rotation of the traction sheave is a horizontal axis.

5. The elevator system of claim 1 wherein:

the controller determines that the counterweight is stuck when T1/T2 exceeds an upper limit or when T2/T1 goes below a lower limit.

6. The elevator system of claims 1 wherein:

the controller determines that the car is stuck when T1/T2 goes below a lower limit or T2/T1 exceeds an upper limit.

7. The elevator system of claim 1 wherein:

the controller stops the machine in response to the traction ratio violating the limit for more than a predetermined time.

* * * * *